US007063772B2

(12) United States Patent
Kahl et al.

(10) Patent No.: US 7,063,772 B2
(45) **Date of Patent: *Jun. 20, 2006**

(54) APPARATUS FOR TREATING A FIBROUS WEB

(75) Inventors: Peter Kahl, Gerstetten (DE); Uwe Joos, Aalen (DE)

(73) Assignee: Voith Paper Patent GmbH, Heidenheim (DE)

( * ) Notice: Subject to any disclaimer, the term of this patent is extended or adjusted under 35 U.S.C. 154(b) by 370 days.

This patent is subject to a terminal disclaimer.

(21) Appl. No.: 10/205,427

(22) Filed: Jul. 26, 2002

(65) Prior Publication Data

US 2003/0034139 A1 Feb. 20, 2003

(30) Foreign Application Priority Data

Aug. 20, 2001 (DE) ..... 101 40 800

(51) Int. Cl.
*D21F 5/00* (2006.01)
*F26B 11/00* (2006.01)

(52) U.S. Cl. ..... 162/363; 162/272; 162/274; 162/364; 162/374; 162/365; 162/278; 162/252; 34/115; 34/122; 34/125; 15/300; 277/906

(58) Field of Classification Search ..... 162/363, 162/272, 274, 364, 374, 365, 278, 279, 252; 34/115, 122, 125; 15/300; 277/906
See application file for complete search history.

(56) References Cited

U.S. PATENT DOCUMENTS

| | | | | |
|---|---|---|---|---|
| 4,996,782 | A | 3/1991 | Eivola | |
| 5,341,579 | A | 8/1994 | Schiel et al. | |
| 6,192,597 | B1 * | 2/2001 | Kahl et al. | 34/115 |
| 6,247,247 | B1 | 6/2001 | Yömaa et al. | |
| 6,740,204 | B1 * | 5/2004 | Kahl et al. | 162/363 |

FOREIGN PATENT DOCUMENTS

| | | |
|---|---|---|
| DE | 4014742 | 11/1990 |
| DE | 4141296 | 6/1993 |
| DE | 19716131 | 10/1998 |
| DE | 20017933 | 2/2001 |

* cited by examiner

*Primary Examiner*—Mark Halpern
(74) *Attorney, Agent, or Firm*—Greenblum & Bernstein, P.L.C.

(57) ABSTRACT

Apparatus for treating a fibrous web that includes at least one supporting surface arranged to support a surface of the fibrous web, and at least one sealing device positionable adjacent a surface of the web opposite the surface of the web supported by the at least one supporting surface. The at least one sealing device includes a positionably adjustable sealing element. A distance between the positionably adjustable sealing element and the surface of the web opposite the surface supported by the at least one supporting surface is adjustable.

75 Claims, 3 Drawing Sheets

APPARATUS FOR TREATING A FIBROUS WEB

CROSS-REFERENCE TO RELATED APPLICATION

The present application claims priority under 35 U.S.C. § 119 of German Patent Application No. 101 40 800.5 filed Aug. 20, 2001, the disclosure of which is expressly incorporated by reference herein in its entirety.

BACKGROUND OF THE INVENTION

1. Field of the Invention

The invention relates to an apparatus for treating a fibrous web, e.g., a paper and/or board web, in which the fibrous web, either alone or together with at least one supporting belt, e.g., a dewatering belt, press belt, mesh belt and/or the like, is guided over at least one moving or stationary supporting surface and, on the side of the fibrous web that faces away from such a supporting surface, at least one sealing device is provided.

2. Discussion of Background Information

Such an apparatus is described, e.g., in German Patent Application No. DE-A-19716131.6.

The relevant sealing device is often provided in the area of an air-based device such as in particular a stabilizer box or the like. Here, an additional vacuum zone can be provided in the upper area of such a stabilizer box. Between the two vacuum zones, that is to say between the upper and the lower vacuum zone, a seal, in particular a seal permanently fixed to the box, can be provided.

SUMMARY OF THE INVENTION

The present invention provides an apparatus of the type mentioned at the beginning in which the sealing device can be adapted to various operating states, in order to permit optimum conditions in particular in a relevant air-based device, e.g., for transferring, spreading and the web run during operation and in the case of different supporting belts, e.g., wires.

According to the invention, an apparatus for treating a fibrous web, such as a paper and/or board web, is arranged so that the fibrous web, on its own or together with at least one supporting belt such as in particular a dewatering belt, press belt, mesh belt and/or the like, is guided over at least one moving or stationary supporting surface and, on the side of the fibrous web that faces away from such a supporting surface, at least one sealing device is provided. The at least one sealing device includes a flexible sealing blade which is held in a holder and can be acted on by a pressing device, via which the distance between the supporting belt and a sealing section of the sealing blade interacting with the supporting belt can be set variably.

On the basis of this construction, the distance between the supporting belt, e.g., a wire, and the sealing section of the sealing element formed by a sealing blade can be varied, in particular even without dismantling or displacement of the entire air-based device, e.g., the entire stabilizer box.

The pressing device can, for example, include a pressing blade. This preferably has a greater stiffness than the sealing blade.

As already indicated, the sealing device can be provided, e.g., in the area of an air-based device, such as in particular in a steam blower box, a suction box, a stabilizer, ventilation fittings and/or the like, used in particular in a press section or a drying section.

According to a preferred embodiment of the apparatus according to the invention, the sealing device is provided in combination with an air-based device, for example a stabilizer box, used in the drying section, as a second sealing device, as viewed in the web running direction, in particular over the machine width, in order in particular to separate an upper and a lower vacuum zone from each other.

In this case, the two vacuum zones can for example be connected to separate vacuum sources, via which the vacuum can accordingly be set separately. The respective setting can be carried out, e.g., via fans or the like associated with the vacuum sources.

However, the two vacuum zones can also be connected to a common vacuum source. In this case, the pressures in the vacuum zones can be set separately, e.g., via flaps or the like.

The first sealing device on the inlet side, as viewed in the web running direction, can in particular be formed by a flexible, floating seal, a mechanical sealing strip, an air knife and/or the like.

According to a preferred practical embodiment of the apparatus according to the invention, the sealing blade is held by its two mutually opposite edges extending transversely with respect to the web running direction in a respective guide, in which the relevant edge sections of the sealing blade can be moved to a limited extent, in order to compensate for or permit a respective displacement of the relevant edge sections, occurring during the adjustment of the distance between the sealing section of the sealing blade and the supporting belt.

In this case, the guides can in each case extend at least substantially over the entire width of the sealing blade, measured transversely with respect to the web running direction.

In an expedient practical embodiment, the guides are in each case designed like channels and the channel walls are in each case provided with a slot which is parallel to the channel axis and through which the respective edge section of the sealing blade extends into the relevant channel.

The sealing blade held at the edges in the guides can preferably be acted on by the pressing device in such a way that it becomes curved towards the supporting belt.

In an advantageous practical embodiment of the apparatus according to the invention, the pressing device, in addition to at least one actuating element, includes at least one spring element arranged between the latter and the blade.

In specific cases, it is advantageous if the pressing device includes at least one actuating element that executes a linear actuating movement.

The pressing device can, for example, also include at least one actuating element formed by a lever. Thus, the actuating element can include, e.g., a two-armed lever, and the sealing blade can be acted on by one of the two lever arms, preferably via at least one spring element connected in between them.

In specific cases, it is advantageous if the pressing device has at least one pressing element, which is mounted such that it can be pivoted about an axis extending transversely with respect to the web running direction. The pivotable pressing element can be actuated by at least one actuating element.

The pressing element provided can in particular be a pressing blade which is mounted such that it can be pivoted about a transverse axis.

The pressing device can, for example, also include at least one pressing element formed by an eccentric element. In this case, the pressing element provided can in particular be at least one eccentric tube extending transversely with respect to the web running direction.

The sealing blade is preferably acted on directly by the eccentric element.

According to an advantageous embodiment, the pressing device has a pressing element provided with a camber. Therefore, the relevant pressing element can, e.g., have a positively or negatively curved edge, in order to set a "camber" of the sealing blade, that is to say a different distance from the supporting belt over the width. Therefore, for example, a deflection of the supporting belt or wire between edge and center can be compensated for.

In specific cases, it is advantageous if the sealing device as a whole is mounted in a compliant or sprung manner on, for example, a relevant air-based device. In the event that lumps or the like occur, the entire sealing construction therefore gives way. In this case, the preferred compliance direction is provided in particular in the running direction of the supporting belt, i.e., in the wire running direction.

The distance between the sealing section of the sealing blade and the supporting belt can be adjusted in particular in a range from about 0 to about 100 mm and preferably in a range from about 5 to 50 mm.

The sealing blade and/or the pressing blade preferably consists of plastic, for example GRP, Teflon, CRP or the like, or of metal.

The sealing blade and/or pressing blade, consisting of GRP, for example, advantageously in each case has a thickness in a range from about 0.2 to about 1.5 mm and preferably in a range from about 0.3 to 1.0 mm.

In particular in the case in which the sealing blade and the pressing blade includes the same material, the sealing blade is preferably thinner or as thick as the pressing blade.

In a preferred embodiment of the apparatus according to the invention, the sealing blade is curved during operation, and the distance between its sealing section and the supporting belt can be predefined via the length of the pressing element, for example likewise formed by a blade.

The distance between the sealing section and the supporting belt can expediently be adjusted automatically. In this case, this distance can be set in particular as a function of the machine speed, the paper grade, the operating state (e.g. break, transfer, spreading, operation), the moisture content, the draw, the pressing force and/or the like.

In an expedient practical embodiment of the apparatus according to the invention, the sealing blade can be moved away from the supporting belt to such an extent that the separation between the upper and the lower vacuum zone is canceled and, instead, a single coherent vacuum zone is formed.

Advantageously, the sealing blade or its sealing section, for example for a supporting-belt change, in particular a wire change, and/or for maintenance purposes, can be removed from the supporting belt to such an extent that the sealing blade assumes a flat form and/or rests parallel on an adjacent wall of the air-based device.

The vacuum in the vacuum zones can advantageously be set and/or regulated automatically. In this case, it is advantageous in particular if the vacuum in the vacuum zones can be matched automatically to the respective operating state of the apparatus, in the event of a respective web break, the vacuum source or sources can be switched off automatically and/or, following a web transfer, the vacuum source or sources can be connected up or regulated automatically.

The sealing blade can extend over the entire machine width or else only over part of the machine width or can be subdivided in the width into at least two zones.

The two vacuum zones can be sealed off at the sides via air knives and/or mechanical sealing plates.

The maximum possible actuating range of the sealing blade or its sealing section can preferably be predefined by stops associated with the sealing blade. Here, the sealing blade can simultaneously be prevented by these stops from sliding out of the guides.

The sealing blade can be provided with through-holes, in order to permit partial flow through, for example into the area behind the sealing blade. The holes preferably have a diameter in the range from about 5 to 50 mm.

The present invention is directed to an apparatus for treating a fibrous web that includes at least one supporting surface arranged to support a surface of the fibrous web, and at least one sealing device positionable adjacent a surface of the web opposite the surface of the web supported by the at least one supporting surface. The at least one sealing device includes a positionably adjustable sealing element. A distance between the positionably adjustable sealing element and the surface of the web opposite the surface supported by the at least one supporting surface is adjustable.

According to a feature of the invention, the sealing element includes a flexible sealing blade and a holder is arranged to hold the flexible sealing blade throughout the distance adjustment. Further, a pressing device is arranged to act on the flexible sealing device in order to effect the distance adjustment.

In accordance with another feature of the invention, the fibrous web includes at least one of a paper and board web.

Further, at least one supporting belt is arranged to support and guide the fibrous web over the at least one support surface and past the at least one sealing device. The at least one supporting belt includes at least one of a dewatering belt, press belt, and mesh belt. Also, the sealing element is positionably adjustable to relative to a surface of the at least one supporting belt opposite the surface supporting the fibrous web. The at least one supporting surface is structured and arranged to be one of a moving or stationary surface, and the pressing device includes at least one pressing blade. The pressing blade is structured to have a greater stiffness than the sealing blade.

Moreover, the sealing device is provided in the area of an air-based device. The air-based device includes one of a steam blower box, a suction box, a stabilizer, and ventilation fittings, and the air-based device is located in one of a press section and a drying section.

Further, the apparatus can be utilized in combination with an air-based device, such that the at least one sealing device is arranged to separate an upper and a lower vacuum zone from each other. The air-based device includes a stabilizer box arranged in a drying section. Still further, the vacuum zones are coupled to separate vacuum sources, via which a vacuum pressure in each zone is separately settable. The two vacuum zones are coupled to a common vacuum source, and vacuum pressures in each vacuum zone separately settable, and the vacuum pressures are separately settable via flaps. Further, a second sealing device arranged upstream of the sealing element, relative to a web run direction, and the second sealing device includes one of a flexible, floating seal, a mechanical sealing strip and an air knife. A guide is arranged to hold two mutually opposite edges of the sealing blade, and the guide is arranged to extend transversely to the web run direction. The guide may be arranged to facilitate limited movement of the edges to compensate for movement of the edges during the distance adjustment, and the guides in each extend at least substantially over an entire width of the sealing blade, measured transversely with respect to the web run direction. Further, the guides include channels, and the channels are formed by channel walls having a slot arranged parallel to a channel axis and through which a respective edge of the sealing blade extends. The sealing blade, which is held at its edges in the guide, is acted on by the pressing device, whereby the sealing blade is curved towards the fibrous web. Further, a support belt is arranged to guide and support the fibrous web over the at least one support surface, and the support belt is arranged to support a surface of the web opposite the surface supported by the at least one support surface, and the sealing blade, which is held at its edges in the guide, is acted on by the pressing device, such that the sealing blade is curved towards the support belt.

According to still another feature of the present invention, the pressing device includes at least one actuating element and at least one spring element between the at least one actuating element and the sealing blade.

In accordance with a further feature, the pressing device includes at least one actuating element executing a linear actuating movement.

Further still, the pressing device includes at least one actuating element formed by a lever. The actuating element includes a two-armed lever, and the sealing blade is structured and arranged to be acted on by one of the two lever arms. Further, the sealing blade is acted upon by the one lever arm via at least one spring element connected between the two lever arms.

The pressing device includes at least one pressing element which is pivotably mounted about an axis extending transversely with respect to a web run direction, and the pivotable pressing element is actuatably by at least one actuating element. Also, the pressing element includes a pressing blade pivotably mounted about a transverse axis.

According to another feature, the pressing device includes at least one pressing element formed by an eccentric element, and the eccentric element includes at least one eccentric tube extending transversely to a web run direction. The sealing blade is acted on directly by the eccentric element.

In accordance with a still further feature of the instant invention, the pressing device includes a pressing element having a camber.

Further, an air-based device is included, so that the sealing device is arranged on the air-based device. The sealing device is mounted in one of a compliant or sprung manner on the air-based device, and wherein the sealing device is compliant in a running direction toward the fibrous material. The distance between a sealing section of the sealing blade and the fibrous web is adjustable within a range from about 0 to about 100 mm. Further, the distance is adjustable within a range from about 5 to about 50 mm. Still further, a support belt is arranged to guide and support the fibrous web over the at least one support surface, and the sealing device is mounted in one of a compliant or sprung manner on the air-based device, and the sealing device is compliant in a running direction toward the support belt. Further, the distance between a sealing section of the sealing blade and the supporting belt is adjustable within a range from about 0 to about 100 mm, and the distance can be adjustable within a range from about 5 to about 50 mm.

At least one of the sealing blade and the pressing blade includes one of plastic or metal, and the plastic includes at least one of GRP, Teflon, CRP.

At least one of the sealing blade and the pressing blade has a thickness in a range from about 0.2 to about 1.5 mm, and can be between about 0.3 to about 1.0 mm. The at least one of the sealing blade and the pressing blade include GRP.

According to another feature of the invention, the sealing blade and the pressing blade include a same material and in the sealing blade is one of thinner or as thick as the pressing blade.

Further, the sealing blade is structured and arranged to be curved during operation, and the distance between a sealing section of the sealing blade and the fibrous web is predefined via a length of the pressing element. The pressing element is formed by a blade. Still further, the distance between the sealing section and the fibrous web is automatically adjustable, and the distance between the sealing section and the fibrous web is set as a function of at least one of machine speed, paper grade, operating state, moisture content, draw, and pressing force, wherein the operating state includes at least one of break, transfer, spreading, and operation conditions.

The sealing blade is arranged to define an upper and a lower vacuum zone, and the sealing blade is structured and arranged to be movable away from the fibrous web to redefine the upper and lower vacuum zones as a single coherent vacuum zone. Further, the sealing blade is structured and arranged to be removable from a sealing position to one of a flat form and to rest parallel on an adjacent wall of an air-based device, and vacuums in the vacuum zones are one of set and regulated automatically. The vacuum in the vacuum zones is automatically matched to the respective operating state of the apparatus, such that, in the event of a respective web break, the vacuum source or sources are automatically switched off and, such that, following a web transfer, the vacuum source or sources are switched on or regulated automatically. The sealing blade extends over an entire machine width. Alternatively, the sealing blade one of extends only over part of a machine width or is subdivided in a width direction into at least two zones. Side regions of the two vacuum zones are sealed off via at least one of air knives and mechanical sealing plates.

A support belt is arranged to guide and support the fibrous web over the at least one support surface, and the sealing blade is structured and arranged to be curved during operation, and the distance between a sealing section of the sealing blade and the support belt is predefined via a length of the pressing element. The pressing element is formed by a blade, and the distance between the sealing section and the support belt is automatically adjustable. Further, the distance between the sealing section and the support belt is set as a function of at least one of machine speed, paper grade, operating state, moisture content, draw, and pressing force, wherein the operating state includes at least one of break, transfer, spreading, and operation conditions.

According to another feature, a maximum possible actuating range of the sealing blade is predefined by stops associated with the sealing blade.

Moreover, stops are structured and arranged to simultaneously prevent the sealing blade from sliding out of the guides.

In accordance with still yet another feature of the present invention, the sealing blade includes through-holes. The through-holes have a diameter in the range from about 5 to about 50 mm.

The present invention is directed to an apparatus for treating a fibrous web that includes at least one supporting surface arranged to support a surface of the fibrous web, at least one supporting belt arranged to guide and support the fibrous web over the at least one supporting surface, and at least one sealing device positionable adjacent a surface of the at least one supporting belt opposite the surface supporting the fibrous web. The at least one sealing device includes a positionably adjustable sealing element, such that a distance between the positionably adjustable sealing element and the at least one support belt is adjustable.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

Figure 1:
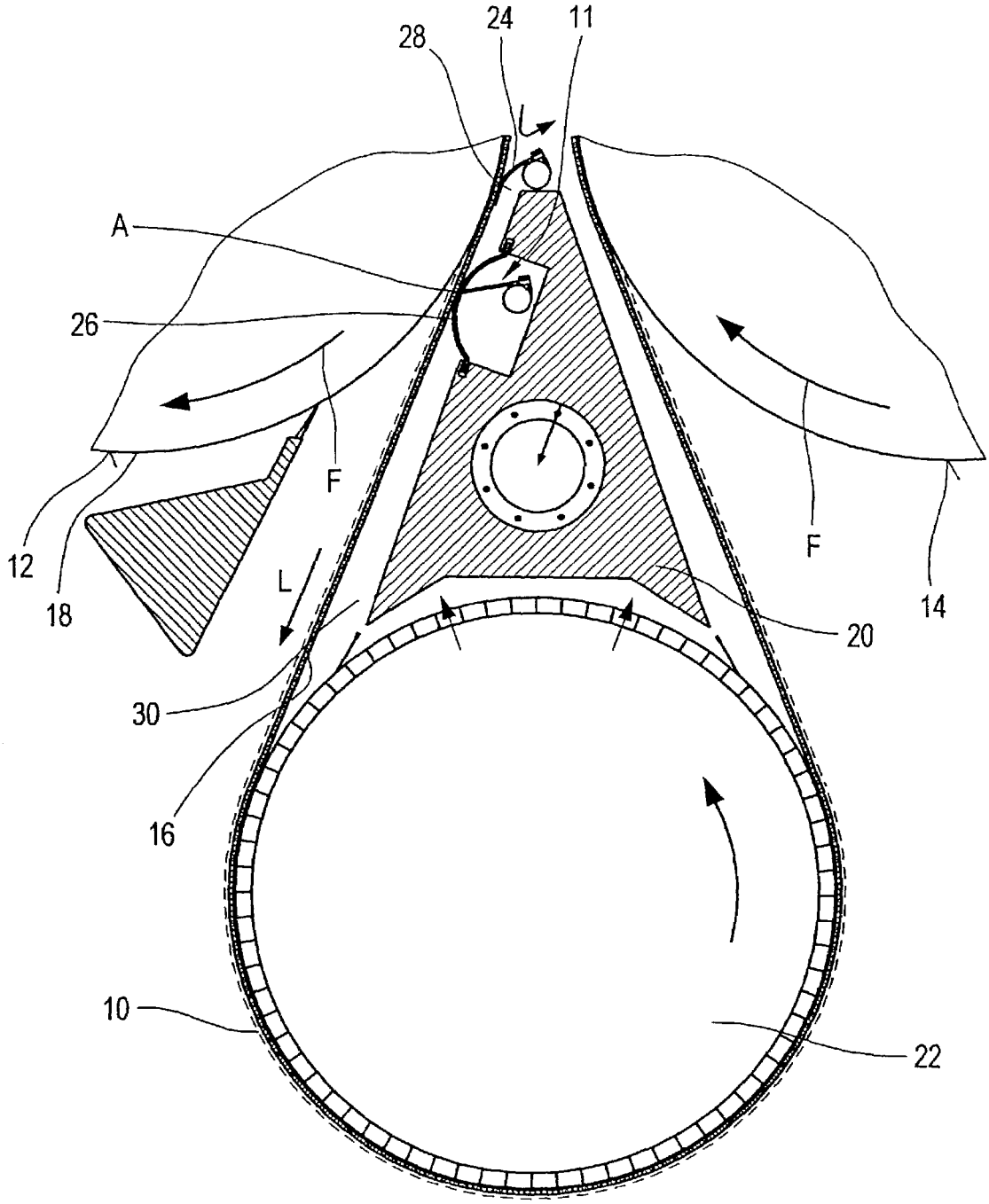
FIG. 1 schematically illustrates a partial view of a drying section of an apparatus for treating a fibrous web, having a sealing device which is associated with a drying cylinder and whose flexible sealing blade can be acted on by a pressing device comprising a pressing blade.

FIG. 1 shows a schematic partial view of a drying section of an apparatus for treating a fibrous web, having two seals provided in the area of a drying cylinder in the upper area of a stabilizer box in order to form an upper and a lower vacuum zone.

The relevant apparatus is used to treat a fibrous web 10, which may in particular be a paper and/or board web.

Indicated in FIG. 1 are two successive drying cylinders 12 and 14, which rotate in the direction of arrows F and over which, together with fibrous web 10, a supporting belt 16 is guided which, in the present case, is formed by a drying fabric.

Supporting belt 16, guided first over left-hand drying cylinder 12 together with fibrous web 10, in a run-off area A runs with fibrous web 10 off supporting surface 18 formed by the outer circumferential surface of drying cylinder 12, in order then to be fed in the web running direction L for example to a perforated and/or grooved deflection roll 22 to which vacuum is applied by an external stabilizer box 20. Stabilizer box 20 in the present case can in particular be a suction box or the like. In principle, however, the sealing arrangement described in more detail in the following text can also be provided in the area of any other desired air-based device, for example even outside the drying section.

On the side of fibrous web 10 that faces away from supporting surface 18 and also of supporting belt 16, in web running direction L, a first seal 24 is provided upstream of the run-off area A. This first seal on the inlet side can be, for example, a flexible, floating seal, a mechanical sealing strip or an air knife.

Provided following first seal 24 is a second seal or sealing device 26 which is arranged downstream of the run-off area A, so that the result is an upper and a lower vacuum zone 28 and 30, respectively. Vacuum is applied to the upper vacuum zone 28 via at feast one vacuum channel 32 (cf. in particular FIGS. 2 and 3). Lower vacuum zone 30 is used, inter alia, to stabilize the web guidance. Upper vacuum zone 28 is used in particular as a "ProRelease" or separation zone. The arrangement overall is therefore used for the controlled separation and stabilization of fibrous web 10.

Sealing device 26 comprises a sealing element which is held in a holder 34 (cf. in particular also FIGS. 2 and 3), which is designed here as a flexible sealing blade 35.

Figure 3:
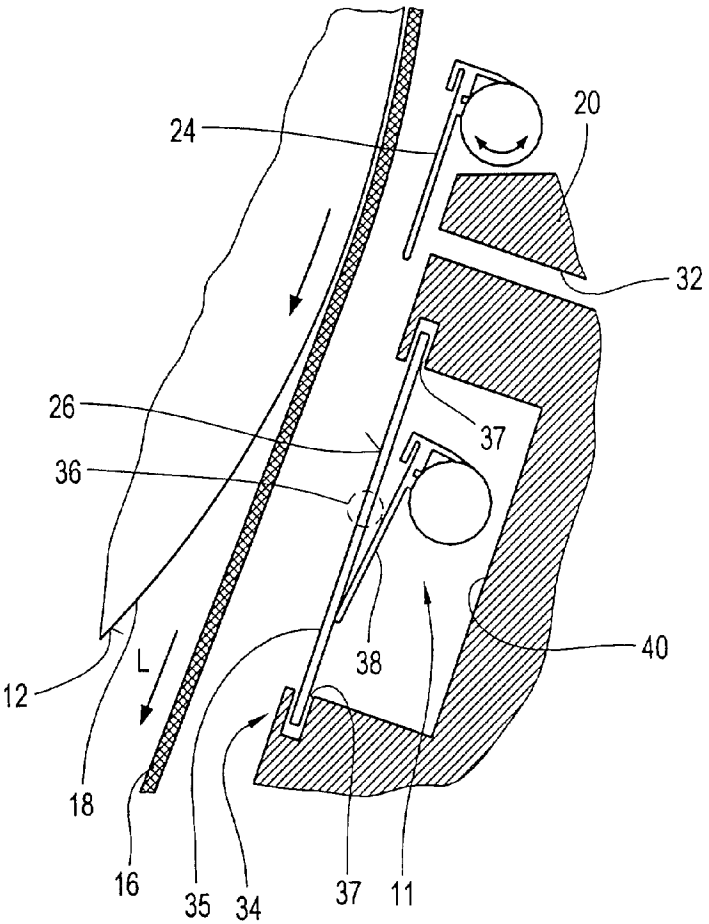
FIG. 3 schematically illustrates an enlarged illustration of the sealing device depicted in FIG. 1, the sealing blade assuming a maintenance position.
Figure 2:
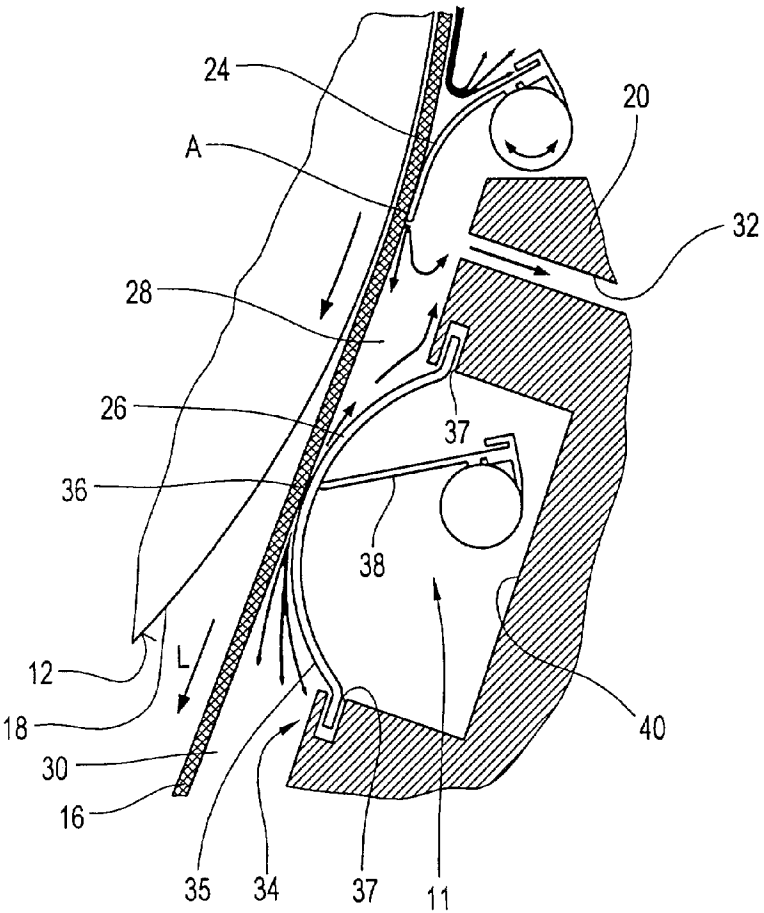
FIG. 2 schematically illustrates an enlarged illustration of the sealing device depicted in FIG. 1, the sealing blade assuming an operating position.

As can be gathered in particular from FIGS. 2 and 3, flexible blade 35 can be adjusted between an operating position (cf. FIG. 2), in which a sealing section 36 of sealing element 34 is arranged in the immediate vicinity of supporting belt 16, and a maintenance position (cf. FIG. 3), in which sealing section 36 is at a greater distance from supporting belt 16.

Flexible sealing blade 35 held in the holder 34 can be acted on by a pressing device 11, via which the distance between sealing belt 16 and sealing section 36 of sealing blade 35 that interacts with supporting belt 16 can be set variably.

As can be gathered in particular from FIGS. 2 and 3, sealing blade 35 is held by its two mutually opposite edges extending transversely with respect to the web running direction in a respective guide 37 of holder 34, in which the relevant edge sections of sealing blade 35 can be moved to a limited extent, in order to compensate for, that is to say to permit, a respective displacement of the relevant edge sections which occurs during adjustment of the distance between sealing section 36 of sealing blade 35 and supporting belt 16.

As can be seen, for example by using FIG. 2, sealing blade 35 can be acted on by pressing device 11 in such a way that it becomes curved towards the supporting belt 16 and, as a result, assumes its operating position.

According to FIG. 3, unloaded sealing blade 35 assuming its maintenance position is at least substantially flat.

In the present case, pressing device 11 comprises at least one pressing blade 38, which preferably has a greater stiffness than sealing blade 35. Pressing blade 38 in the present case is accommodated in a recess 40 in stabilizer box 20, the recess is at least partly covered by sealing blade 35.

Pressing blade 38 can be pivoted about an axis extending transversely with respect to the web running direction L. Respective pivoting can in particular be carried out automatically by means of at least one appropriate actuating element.

Figure 4:
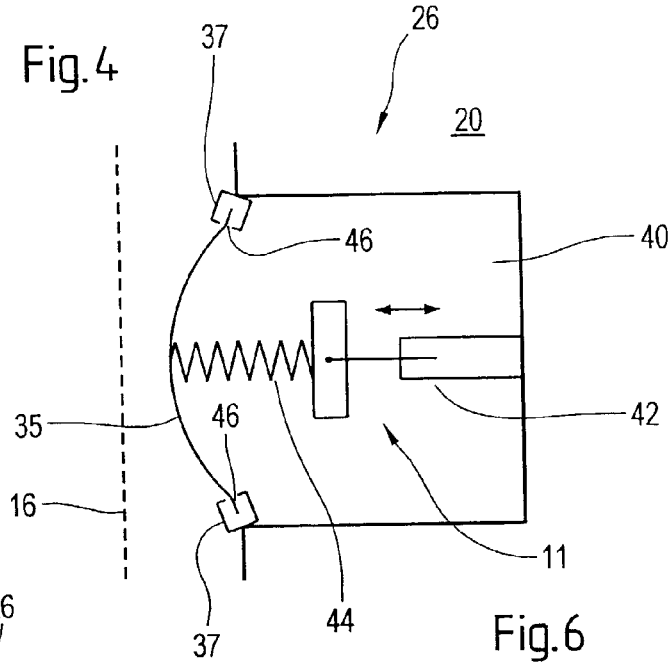
FIG. 4 schematically illustrates a further embodiment of the sealing device, whose sealing blade can be acted on by a pressing device which comprises at least one actuating element and at least one spring element arranged between the latter and the sealing blade.

FIG. 4 shows a schematic illustration of a further embodiment of sealing device 26. In this case, flexible sealing blade 35 can be acted on by a pressing device 11, which comprises at least one actuating element 42 and at least one spring element 44 arranged between the latter and sealing blade 35.

Flexible sealing blade 35 can in turn be acted on by pressing device 11 such that it becomes curved towards supporting belt 16.

As can be seen by using FIG. 4, guides 37, in which flexible sealing blade 35 is held at the edges, are in each case designed like channels. In this case, they are each provided with a slot 46 which is parallel to the channel axis and through which the respective edge section of sealing blade 35 extends into the relevant channel (cf. also FIGS. 5 to 7).

Guides 37 can in each case extend at least substantially over the entire width of sealing blade 35, measured transversely with respect to web running direction L.

As can be seen by using FIG. 4, actuating element 42 in the present case executes a linear actuating movement.

Pressing device 11 is again arranged in a recess 40 of stabilizer box 20.

Figure 5:
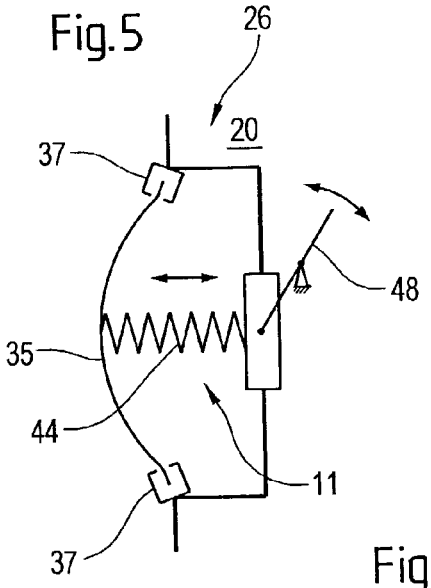
FIG. 5 schematically illustrates a further embodiment of the sealing device, in which the pressing device comprises at least one actuating element formed by a lever.

FIG. 5 shows a schematic illustration of a further embodiment of sealing device 26. In this case, pressing device 11 comprises at least one actuating element 48 formed by a lever. As can be seen by using FIG. 5, it is a two-armed lever here, it being possible for sealing blade 35 to be acted on by one of the two lever arms, preferably again via at least one spring element 44 connected between them.

Otherwise, this embodiment can have at least substantially the same construction as that of FIG. 4, mutually corresponding parts being assigned the same reference symbols.

Figure 6:
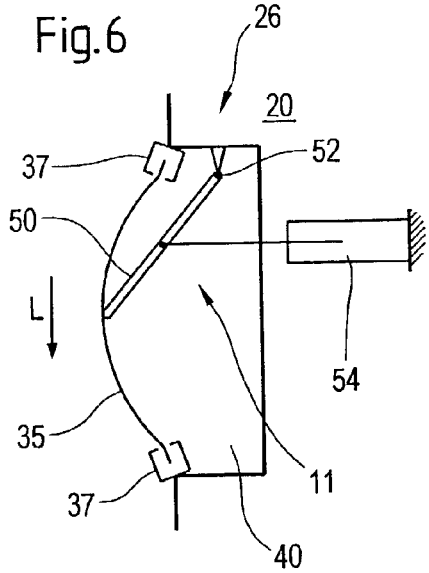
FIG. 6 schematically illustrates a further embodiment of the sealing device, in which the pressing device comprises at least one pressing element which is mounted such that it can be pivoted about an axis extending transversely with respect to the web running direction.

FIG. 6 shows a schematic illustration of a further embodiment of sealing device 26. In this case, pressing device 11 comprises at least one pressing element 50, which is mounted such that it can be pivoted about an axis 52 extending transversely with respect to web running direction L. The pivoting bearing and pressing element 50 can in particular again be arranged in a recess 40 in stabilizer box 20.

As can be seen by using FIG. 6, pivotable pressing element 50 can be acted on or pivoted by at least one actuating element 54.

Otherwise, this embodiment can at least substantially again have the same construction as that described previously, mutually corresponding parts being assigned the same reference symbols.

Figure 7:
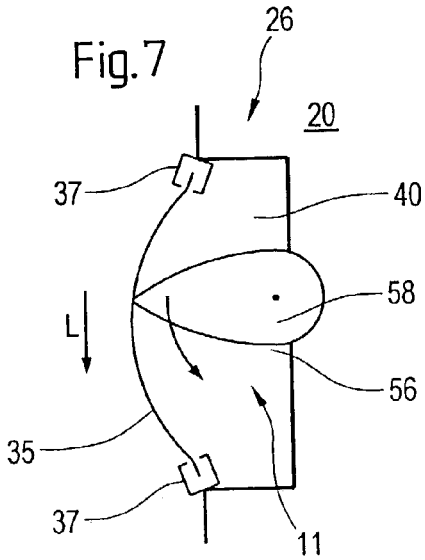
FIG. 7 schematically illustrates a further embodiment of the sealing device, in which the pressing device comprises at least one pressing element formed by an eccentric.

FIG. 7 shows a schematic illustration of a further embodiment of sealing device 26. In this case, pressing device 11 comprises at least one pressing element 56 formed by an eccentric. Here, pressing element 56 provided can in particular be at least one eccentric tube extending transversely with respect to web running direction L. This pressing element, formed by an eccentric, can be pivoted about an axis 58. In the present case, flexible sealing blade 35 is acted on directly by the eccentric.

Pressing element 56 formed in the present case by an eccentric can again be arranged, at least partly, in a recess 40 in stabilizer box 20.

Otherwise, this embodiment can also again have at least substantially the same construction as that described previously. Mutually corresponding parts are again assigned the same reference symbols.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the invention has been described herein with reference to particular means, materials and embodiments, the invention is not intended to be limited to the particulars disclosed herein. Instead, the invention extends to all functionally equivalent structures, methods and uses, such as are within the scope of the appended claims.

What is claimed:

1. An apparatus for treating a fibrous web comprising:

at least one supporting surface arranged to support a surface of the fibrous web;

at least one first sealing device forms an upper vacuum zone;

at least one second sealing device arranged, to form a lower vacuum zone and said upper vacuum zone, positionable adjacent a surface of the web opposite the surface of the web supported by the at least one supporting surface; and said at least one second sealing device comprising a positionably adjustable sealing element, wherein a distance between said positionally adjustable sealing element and said surface of the web opposite the surface supported by the at least one supporting surface is adjustable.

2. The apparatus in accordance with claim 1, wherein said sealing element comprises a flexible sealing blade and a holder is arranged to hold said flexible sealing blade throughout the distance adjustment.

3. The apparatus in accordance with claim 2, further comprising a pressing device arranged to act on said sealing element in order to effect the distance adjustment.

4. The apparatus in accordance with claim 1, wherein the fibrous web comprises at least one of a paper and board web.

5. The apparatus in accordance with claim 1, further comprising at least one supporting belt arranged to support and guide the fibrous web over said at least one support surface and past at least one of said first and second sealing device.

6. The apparatus in accordance with claim 5, wherein said at least one supporting belt comprises at least one of a dewatering belt, press belt, and mesh belt.

7. The apparatus in accordance with claim 5, wherein said sealing element is positionably adjustable to relative to a surface of said at least one supporting belt opposite the surface supporting the fibrous web.

8. The apparatus in accordance with claim 5, wherein said at least one supporting surface is structured and arranged to be one of a moving or stationary surface.

9. The apparatus in accordance with claim 3, wherein the pressing device comprises at least one pressing blade.

10. The apparatus in accordance with claim 9, wherein said pressing blade is structured to have a greater stiffness than said sealing element.

11. The apparatus in accordance with claim 1, wherein said sealing device is provided in the area of an air-based device.

12. The apparatus in accordance with claim 11, wherein said air-based device comprises one of a steam blower box, a suction box, a stabilizer, and ventilation fittings.

13. The apparatus in accordance with claim 11, wherein said air-based device is located in one of a press section and a drying section.

14. The apparatus in accordance with claim 1 in combination with an air-based device, wherein said at least one second sealing device is arranged to separate said upper and said lower vacuum zone from each other.

15. The apparatus in accordance with claim 14, wherein said air-based device comprises a stabilizer box arranged in a drying section.

16. The apparatus in accordance with claim 14, wherein said upper and said lower vacuum zones are coupled to separate vacuum sources, via which a vacuum pressure in each zone is separately settable.

17. The apparatus in accordance with claim 14, wherein said upper and said lower vacuum zones are coupled to a common vacuum source, and vacuum pressures in each vacuum zone separately settable.

18. The apparatus in accordance with claim 17, wherein said vacuum pressures are separately settable via flaps.

19. The apparatus in accordance with claim 14, further comprising said first sealing device arranged upstream of said sealing element, relative to a web run direction.

20. The apparatus in accordance with claim 19, wherein said second sealing device comprises one of a flexible, floating seal, a mechanical sealing strip and an air knife.

21. The apparatus in accordance with claim 14, further comprising a guide arranged to hold two mutually opposite edges of said sealing element, said guide arranged to extend transversely to the web run direction.

22. The apparatus in accordance with claim 21, wherein said guide is arranged to facilitate limited movement of said edges to compensate for movement of said edges during said distance adjustment.

23. The apparatus in accordance with claim 22, wherein said guide extends at least substantially over an entire width of said sealing element, measured transversely with respect to the web run direction.

24. The apparatus in accordance with claim 21, wherein said guide comprises channels.

25. The apparatus in accordance with claim 24, wherein said channels are formed by channel walls having a slot arranged parallel to a channel axis and through which a respective edge of said sealing blade extends.

26. The apparatus in accordance with claim 21, wherein said sealing element, which being held at its edges in said guide, is acted on by said pressing device, whereby said sealing element is curved towards the fibrous web.

27. The apparatus in accordance with claim 21, further comprising a support belt arranged to guide and support the fibrous web over said at least one support surface, wherein said support belt is arranged to support a surface of the web opposite the surface supported by said at least one support surface, and wherein said sealing element, which is held at its edges in said guide, is acted on by said pressing device, whereby said sealing blade is curved towards said support belt.

28. The apparatus in accordance with claim 1, wherein a pressing device comprises at least one actuating element and at least one spring element between said at least one actuating element and a sealing blade.

29. The apparatus in accordance with claim 1, wherein a pressing device comprises at least one actuating element executing a linear actuating movement.

30. The apparatus in accordance with claim 1, wherein a pressing device comprises at least one actuating element formed by a lever.

31. The apparatus in accordance with claim 30, wherein said actuating element comprises a two-armed lever, and said sealing blade is structured and arranged to be acted on by one of the two lever arms.

32. The apparatus in accordance with claim 31, wherein said sealing blade is acted upon by said one lever arm via at least one spring element connected between the two lever arms.

33. The apparatus in accordance with claim 1, wherein a pressing device comprises at least one pressing element which is pivotably mounted about an axis extending transversely with respect to a web run direction.

34. The apparatus in accordance with claim 33, wherein said pivotable pressing element is actuatably by at least one actuating element.

35. The apparatus in accordance with claim 33, wherein said pressing element comprises a pressing blade pivotably mounted about a transverse axis.

36. The apparatus in accordance with claim 1, wherein a pressing device comprises at least one pressing element formed by an eccentric element.

37. The apparatus in accordance with claim 36, wherein said eccentric element comprises at least one eccentric tube extending transversely to a web run direction.

38. The apparatus in accordance with claim 36, wherein said sealing blade is acted on directly by said eccentric element.

39. The apparatus in accordance with claim 1, wherein a pressing device comprises a pressing element having a camber.

40. The apparatus in accordance with claim 1, further comprising an air-based device, wherein said second sealing device is arranged on the air-based device.

41. The apparatus in accordance with claim 40, wherein said second sealing device is mounted in one of a compliant or sprung manner on said air-based device, and wherein said second sealing device is compliant in a running direction toward the fibrous material.

42. The apparatus in accordance with claim 41, wherein the distance between a sealing section of said second sealing element and the fibrous web is adjustable within a range from about 0 to about 100 mm.

43. The apparatus in accordance with claim 42, wherein the distance is adjustable within a range from about 5 to about 50 mm.

44. The apparatus in accordance with claim 40, further comprising a support belt arranged to guide and support the fibrous web over said at least one support surface, wherein said sealing device is mounted in one of a compliant or sprung manner on said air-based device, and wherein said sealing device is compliant in a running direction toward said support belt.

45. The apparatus in accordance with claim 41, wherein the distance between a sealing section of said sealing element and said supporting belt is adjustable within a range from about 0 to about 100 mm.

46. The apparatus in accordance with claim 42, wherein the distance is adjustable within a range from about 5 to about 50 mm.

47. The apparatus in accordance with claim 1, wherein said sealing element and a pressing blade comprises one of plastic or metal.

48. The apparatus in accordance with claim 47, wherein said plastic comprises at least one of glass fiber reinforced plastic, polytetrafluoroethylene, and carbon fiber reinforced plastic.

49. The apparatus in accordance with claim 1, wherein said sealing element and a pressing blade have a thickness in a range from about 0.2 to about 1.5 mm.

50. The apparatus is accordance with claim 49, wherein said range is between about 0.3 to about 1.0 mm.

51. The apparatus in accordance with claim 49, wherein said at least one of said sealing element and said pressing blade comprises glass fiber reinforced plastic.

52. The apparatus in accordance with claim 1, wherein said sealing element and a pressing blade comprise a same material and in said sealing element is one of thinner or as thick as said pressing blade.

53. The apparatus in accordance with claim 1, wherein said sealing element is structured and arranged to be curved during operation, and the distance between a sealing section of said sealing element and the fibrous web is predefined via a length of a pressing element.

54. The apparatus in accordance with claim 53, wherein said pressing element is formed by a blade.

55. The apparatus in accordance with claim 53, wherein the distance between said sealing section and the fibrous web is automatically adjustable.

56. The apparatus in accordance with claim 55, wherein the distance between said sealing section and the fibrous web is set as a function of at least one of machine speed, paper grade, operating state, moisture content, draw, and pressing force.

57. The apparatus in accordance with claim 56, wherein said operating state comprises at least one of break, transfer, spreading, and operation conditions.

58. The apparatus in accordance with claim 1, wherein said sealing element is arranged to define said upper and said lower vacuum zone, and said sealing element is structure and arranged to be movable away from the fibrous web to redefine said upper and said lower vacuum zones as a single coherent vacuum zone.

59. The apparatus in accordance with claim 58, wherein said sealing element is structured and arranged to be removable from a sealing position to one of a flat form and to rest parallel on an adjacent wall of an air-based device.

60. The apparatus in accordance with claim 58, wherein a vacuum in said upper and said lower vacuum zones are one of set and regulated automatically.

61. The apparatus in accordance with claim 60, wherein said vacuum in said upper and said lower vacuum zones is automatically matched to the respective operating state of said apparatus, such that, in the event of a respective web break, the vacuum source or sources are automatically switched off and, such that, following a web transfer, the vacuum source or sources are switched on or regulated automatically.

62. The apparatus in accordance with claim 58, wherein said sealing element extends over an entire machine width.

63. The apparatus in accordance with claim 58, wherein said sealing element one of extends only over part of a machine width or is subdivided in a width direction into at least two zones.

64. The apparatus in accordance with claim 58, wherein side regions of said upper and said lower vacuum zones are sealed off via at least one of air knives and mechanical sealing plates.

65. The apparatus in accordance with claim 1, further comprising a support belt arranged to guide and support the fibrous web over said at least one support surface, wherein said sealing element is structured and arranged to be curved during operation, and the distance between a sealing section of said sealing blade and said support belt is predefined via a length of a pressing element.

66. The apparatus in accordance with claim 65, wherein said pressing element is formed by a blade.

67. The apparatus in accordance with claim 65, wherein the distance between said sealing section and said support belt is automatically adjustable.

68. The apparatus in accordance with claim 67, wherein the distance between said sealing section and said support belt is set as a function of at least one of machine speed, paper grade, operating state, moisture content, draw, and pressing force.

69. The apparatus in accordance with claim 68, wherein said operating state comprises at least one of break, transfer, spreading, and operation conditions.

70. The apparatus in accordance with claim 1, wherein a maximum possible actuating range of said sealing element is predefined by stops associated with said sealing element.

71. The apparatus in accordance with claim 21, further comprising stops structured and arranged to simultaneously prevent said sealing element from sliding out of the guide.

72. The apparatus in accordance with claim 1, wherein said sealing element includes through-holes.

73. The apparatus in accordance with claim 72, wherein said through-holes have a diameter in the range from about 5 to about 50 mm.

74. An apparatus for treating a fibrous web comprising:

at least one supporting surface arranged to support a surface of the fibrous web;

at least one supporting belt arranged to guide and support the fibrous web over said at least one supporting surface;

at least one first sealing device positionable adjacent a surface of said at least one supporting belt opposite the surface supporting the fibrous web forming a upper vacuum zone;

at least one second sealing device, positionable adjacent a surface of said at least one supporting belt opposite the surface supporting the fibrous web, arranged between a lower vacuum zone and said upper vacuum zone;

said at least one sealing device comprising a positionably adjustable sealing element, wherein a distance between said positionably adjustable sealing element and said at least one support belt is adjustable.

75. An apparatus for treating a fibrous web comprising:

at least one supporting surface arranged to support a surface of the fibrous web;

at least one first sealing device forms a first vacuum zone;

at least one second sealing device arranged, to form a second vacuum zone and said first vacuum zone positioned adjacent a surface of the web opposite the surface of the web supported by the at least one supporting surface; and said at least one second sealing device comprising a positionably adjustable sealing element, wherein a distance between said positionally adjustable sealing element and said surface of the web opposite the surface supported by the at least one supporting surface is adjustable, wherein said sealing element includes one or more blades and at least one guide, such that said at least one guide holds at least one outer end of said one or more blades which extends transversely to the web run direction.

* * * * *